US008393704B2

(12) United States Patent
Lutz

(10) Patent No.: US 8,393,704 B2
(45) Date of Patent: Mar. 12, 2013

(54) METHOD FOR CALIBRATING AN INKJET PRINTER AND PRINT PRODUCT

(75) Inventor: Patrik Lutz, Markt Erlbach (DE)

(73) Assignee: Padaluma Ink-Jet-Solutions GmbH & Co. KG, Marlct Erlbach (DE)

( * ) Notice: Subject to any disclaimer, the term of this patent is extended or adjusted under 35 U.S.C. 154(b) by 0 days.

(21) Appl. No.: 12/946,275

(22) Filed: Nov. 15, 2010

(65) Prior Publication Data

US 2011/0122185 A1 May 26, 2011

Related U.S. Application Data

(63) Continuation of application No. PCT/EP2009/003196, filed on May 5, 2009.

(30) Foreign Application Priority Data

May 14, 2008 (DE) ..... 10 2008 023 546

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

| | | | | |
|---|---|---|---|---|
| 2003/0103098 | A1* | 6/2003 | Yashima et al. | 347/15 |
| 2004/0021724 | A1 | 2/2004 | Kojima | |
| 2006/0055720 | A1* | 3/2006 | Olson et al. | 347/19 |
| 2007/0211092 | A1* | 9/2007 | Shingyohuchi et al. | 347/10 |
| 2007/0229559 | A1* | 10/2007 | Oku | 347/9 |

FOREIGN PATENT DOCUMENTS

WO 2006093342 A1 9/2006

OTHER PUBLICATIONS

International Search Report dated Aug. 25, 2009.

* cited by examiner

*Primary Examiner* — Laura Martin
(74) *Attorney, Agent, or Firm* — Laurence A. Greenberg; Werner H. Stemer; Ralph E. Locher

(57) ABSTRACT

An inkjet printer has a print head with a number of ink ejecting nozzles that are driven by way of a control signal. The print head is calibrated near the time of the intended printing operation. A predefined calibration screen is printed with the inkjet printer, the value of a measurement parameter characterizing the ink application is determined on the basis of the printed calibration screen, and the ink ejection quantity per dot is calibrated. The calibration includes adapting the control signal using the determined value of the measurement parameter. A print product is printed by an inkjet printer that has been calibrated in this way.

16 Claims, 4 Drawing Sheets

METHOD FOR CALIBRATING AN INKJET PRINTER AND PRINT PRODUCT

CROSS-REFERENCE TO RELATED APPLICATION

This application is a continuation, under 35 U.S.C. §120, of copending international application No. PCT/EP2009/003196, filed May 5, 2009, which designated the United States; this application also claims the priority, under 35 U.S.C. §119, of German patent application No. DE 10 2008 023 546.6, filed May 14, 2008; the prior applications are herewith incorporated by reference in their entirety.

BACKGROUND OF THE INVENTION

Field of the Invention

The invention relates to a method for calibrating an inkjet printer. The invention furthermore relates to a print product printed by a correspondingly calibrated inkjet printer.

In an inkjet printer, a printed image is generated by the targeted ejection or deflection of ink dots. The printed image is composed of a screen of individual dots, wherein the attainable resolution is substantially given by the number of ink ejecting nozzles combined in a print head per area. The printed image arises by the print head being moved, with corresponding activation of the nozzles, relative to the substrate to be printed. The resolution of an inkjet printer is generally specified by dpi (dots per square-inch). In principle, the printed image can be printed, depending on the choice of ink, on a wide variety of substrates such as, for example, paper, wood, laminate, glass, textile or plastic.

The field of use of inkjet printers is broad and extends from known applications in the office and home sectors through to professional applications in the commercial sector. In the commercial sector, in particular, a consistently uniform printed image has to be ensured in conjunction with high production numbers. By way of example, the printed result in the case of a decorative imprint on laminate or wood panels must not deviate even in different batches, such that uniform floor or wall coverings arise even with the use of individual elements of different batches or an invisible exchange of worn or damaged elements is made possible for the end customer. Consequently, the printed image has to be reproducible with a uniform appearance.

As is known, however, the printed result of an inkjet printer is influenced by external factors such as, for example, air pressure, temperature or air humidity. For these factors influence, inter alia, the consistency of the ink used, in particular with regard to density, viscosity, flowability, surface tension, etc., such that different conditions are established in the ink ejecting nozzles. Accordingly, the printed dots on one day will differ from the printed dots on another day. In other words, an inkjet printer has, as it were, a form on the day. This effect is unimportant in the case of small printers for private domestic use or for office use. In the case of commercial use with high quality demands, however, the resultant deviations of the individual printed images in different batches cannot be tolerated. In particular, a different form on the day leads to a changed ink application, such that, despite the same dot screen, the printed image appears sometimes brighter or sometimes darker to an observer. This also changes a desired color character since mixed colors are generated in an inkjet printer by varying the printing screen of given primary colors.

In order to compensate for this form on the day of an inkjet printer, usually the procedure hitherto has involved generating a printed image with different predefined dot screens and measuring the color density produced. Depending on the form on the day, the measured color density will differ since the constitution of the individual dots varies. One conventional approach then involves the real color density measured per dot screen being adjusted to the desired color density by changing the dot screen. In other words, a calibration curve is measured, which apportions a change value to each dot screen in order to obtain the color density actually desired. The digital image original, which assigns a specific screen of a specific color to a specific print region of the printed image, is then altered by means of corresponding software and passed to the inkjet printer. The latter then prints a dot screen changed by comparison with the digital original, but the printed image generated conveys the desired and, in particular, uniform, reproducible color impression. This is also referred to as a so-called frequency modulation of the control signal since the signal sequence for driving the ink ejecting nozzles is temporally modified in order to generate the modified dot screen.

Patent application publication US 2005/0156976 A1 proposes, for the purpose of calibrating an inkjet printer, printing ink applications in a matrix scheme for respectively two primary colors, wherein the ink application of one primary color is varied in the direction of the rows and the ink application of the other primary color is varied in the direction of the columns. In order to vary the ink application, that document discloses varying the ink ejection energy or the dot screen. The matrix scheme is subsequently measured. That matrix element which has the least color impression is selected. Proceeding from the selected matrix element, the corresponding energy parameters are chosen or read from a relationship between ink ejection energy and drop mass. As a result, the ink ejection quantities of the primary colors chosen are adjusted relative to one another. However, the ink application per dot disadvantageously still varies depending on the form on the day of the inkjet printer.

For an inkjet printer having print cartridges having the same color with different saturation, published patent application US 2003/0234828 A1 proposes a calibration method for balancing the two colors with one another. For this purpose, a color mixture is determined which produces the same reflection signal independently of the emission spectra of the measuring sensors. For each of the two colors, a specific print-out corresponding to the print-out of the color mixture is determined. For calibration purposes, for each color screens having a different ink application are printed and these are compared with a print-out of the same color, which is specified for the print-out of the color mixture. In this respect, the two colors are calibrated to a common reference point, independent of sensors, and thus coordinated with one another. In that case, too, the individual dot is not important. Rather, the two colors are balanced with one another by a screen adaptation.

Printed images of the same original that are printed with different dot screens, despite an identical color density with respect to one another, disadvantageously exhibit so-called metamerism, however. While the printed images appear identical in artificial light, for example, the color impression of one image deviates from the color impression of the other image, however, in daylight, for example in evening light. This is owing to the fact that different reflectance curves of the printed images observed, in the case of specific illumination, can bring about the same color impression since the human eye is not able to receive each wavelength individually. Rather, the eye has three color vision regions of different spectral sensitivity. The hue perceived in total by the observer results from a superimposition of the light components entering the eye in accordance with the reflectance curve and the respective sensitivity of the three color vision regions of the eye. The actual varicolored nature of metameric printed images becomes visible, however, upon observation under a light having a different spectral composition. It is exactly this effect that is not eliminated by the conventional calibration methods.

SUMMARY OF THE INVENTION

It is accordingly an object of the invention to provide a method of calibrating an inkjet printer and print product which overcome the above-mentioned disadvantages of the heretofore-known devices and methods of this general type and which provides for an alternative method for calibrating an inkjet printer such that a desired printed image can be printed independently of the form on the day of the printer as reproducibly as possible and as far as possible without the occurrence of metamerism.

With the foregoing and other objects in view there is provided, in accordance with the invention, a method of calibrating an inkjet printer having a print head with a plurality of ink ejecting nozzles to be driven by way of a control signal. The method, which is to carried out near a time of an intended printing operation, comprises the following steps:

printing an individual predefined calibration screen with the inkjet printer for a given color;

determining from the printed calibration screen a value of a measurement parameter characterizing the ink application, the measurement parameter being averaged over an entire printed image; and calibrating an ink ejection quantity per dot to a predefined standard value using the value of the measurement parameter obtained in the determining step by adapting the control signal.

In other words, the object directed to a method is achieved according to the invention, for an inkjet printer with a print head comprising a number of ink ejecting nozzles which can be driven by means of a control signal, by means of a calibration method wherein, near the time of the intended printing operation, an individual predefined calibration screen is printed by means of the inkjet printer for a color, wherein the value of a measurement parameter characterizing the ink application, said measurement parameter being averaged over the entire printed image, is determined on the basis of the printed calibration screen, and wherein the ink ejection quantity per dot is calibrated to a predefined standard value using the determined value of the measurement parameter by adapting the control signals.

In a first step, the invention is based on the consideration that the undesirable metamerism is a consequence of the change in the dot screens for the calibration of the color density. In a second step, the invention then recognizes that the ambient parameters influencing the form on the day of an inkjet printer crucially define the ink quantity produced per dot or the ink quantity produced per ink ejection. Finally, in a third step, the invention recognizes the surprising possibility that the ink ejection quantity can be calibrated by adapting the control signal. This is because if the control parameters are varied for the ejection of an ink drop, then the ejected ink quantity would also vary. However, if the ink ejection is calibrated to an ink ejection quantity per dot, then a reproducible printed image substantially free of metamerism can be achieved since the dot screen is not altered for the adaptation of the color density.

The method specified has the further significant advantage that it is no longer necessary to adapt the digital original in a complicated manner for calibration independently of the form on the day or independently of the type of printer prior to sending to the printer. For the ink ejection quantity per dot is calibrated by a setting of the control signal, such that printing with repeatable uniform image quality is always effected whilst retaining the dot screens given by the digital original. As a result of the calibration of the ink ejection quantity, in particular the size of the dots is also kept substantially constant independently of external factors. The printed images no longer differ because, with the same dot screen, the same ink application is always produced by means of a setting change on the apparatus side.

In order to calibrate the ink ejection quantity, firstly a defined calibration screen is printed for a color and the value of a measurement parameter characterizing the ink application is determined on the basis of the printed calibration screen. Such a measurement parameter can be, for example, the size, the thickness or the mass of a printed dot, wherein the average is taken over the entire printed image. Such a measurement parameter is detected, for example, by determining the difference in thickness or in weight between the unprinted substrate and the printed substrate. The ink application can also be detected optically by determining the reflection, transmission or reflectance values. In particular, it is appropriate to detect, as measurement parameter, a color density optically by means of a so-called densitometer, which detects the reflectance of the printed image, that is to say the diffuse reflection of the ambient light. It is also conceivable to detect the ink application microscopically by means of an assessment of the applied dots. The proportion of the area printed with dots can also be determined as measurement parameter, said proportion being dependent on the size of the dots in the case of a predefined dot screen.

In this respect, any measurement parameter is suitable for calibration provided that it has a dependence on the ink quantity produced during an ink ejection, this ultimately being expressed in the form, size or thickness of the dots.

Using the determined value for the chosen measurement parameter, it is accordingly possible to calibrate the ink ejection quantity per dot. As a result, a uniform printed image or a uniform dot print is obtained independently of the form on the day of the inkjet printer and also independently of the type of inkjet printer. An adaptation of the dot screen is no longer necessary. For any print and for any inkjet printer it is possible to use the same digital original without adaptation by calibration software. The desired uniform printed image always arises. Even fluctuations in the ink quality are compensated for by the calibration method specified.

A further advantage over known calibration methods is the fact that, for determining the ink ejection quantity or for calibration, it suffices to print a single calibration screen for one color. At most, in the case of a plurality of primary colors such as, for example, the four primary colors cyan, magenta, yellow and black in four-color printing, the inks of the primary colors having differing chemical or physical properties, it is necessary to print a calibration screen for each color. There is no need to determine a calibration curve by detecting the printed result in the case of a plurality of calibration screens having different resolutions.

The ink ejection quantity is calibrated to a predefined standard value by correspondingly adapting the measurement parameter. This can be performed, for example, by the control signal being changed, printing being effected again with the changed control signal and measurement being carried out anew, wherein the method is repeated until the desired result is achieved. From this method it is also possible to derive empirical values which are used during a renewed calibration for automated adaptation of the control signal.

Advantageously, for calibration purposes, the determined value of the measurement parameter is compared with a predefined comparison value and the ink ejection quantity per dot is calibrated in a manner dependent on the result of the comparison. In other words, calibration is effected with respect to a defined reference point. In this respect, an absolute value of the measurement parameter is not of importance. The predefined comparison value relates, for example, to a generally or apparatus-specifically standardized ink ejection quantity or to an ink ejection quantity of the inkjet printer under defined normal conditions with regard to the ambient parameters. It is also possible to determine the comparison value from a number of values of the measurement parameter that are measured ahead of the calibration, for example on the basis of averaging.

Advantageously, a color density is determined as the measurement parameter characterizing the ink application. The color density, already mentioned, yields, in particular in printing technology, a measure of the brightness or darkness of a printed area. In this respect, the color density is linked to the proportion of the printed area on the substrate. Therefore, a reliable measure for characterization of the ink application can be determined from the color density value determined on the printed calibration screen. Mathematically, the color density is derived from the degree of reflectance. In this case, the degree of reflectance denotes the proportion of the incident light that is reflected from the observed area or printed image. In this case, the degree of reflectance of an ideally white area is assumed to be one. The color density is formed in particular as a common logarithm from the reciprocal of the degree of reflectance, which results in a value of zero in the case of the ideally white area for the color density. The logarithmic relationship is chosen, in particular, in order to take account of the logarithmic brightness perception of the human eye. If one-tenth of the light is reflected, then the color density has the value 1. In the case of different primary colors, the value of the color density is preferably determined separately for each primary color on the basis of a printed calibration screen.

The color density is a conventional measurement parameter in printing technology. In this respect, it is possible to have recourse to known measurement methods when determining the corresponding values of the color density. The value of the color density is expediently determined by means of an optical measurement. In this case, it is possible to have recourse to tried and tested measurement technology such as, for example, to a densitometer or to a spectral photometer.

Inkjet printers exist in various embodiments. Thus, in the case of the so-called bubble-jet printer, the ink droplets are expelled by the local production of a vapor bubble. Inkjet printers in which the ink droplets are ejected by means of a pressure-valve technique are also known. In the abovementioned configuration variants, too, the ink quantity ejected per ink drop can be influenced by adapting the control signal.

In one preferred embodiment, however, the or each ink ejecting nozzle comprises a piezo-actuator, which is driven to eject ink by means of the control signal. By means of the piezo-actuator, ink ejection by the corresponding ink ejecting nozzle is achieved in particular by means of a pressure surge. In this case, the ink is generally conveyed from an assigned ink chamber. As a result of an electrical voltage being applied, the piezo-actuator is excited to effect a movement which abruptly reduces the volume in the ink channel assigned to the respective ink ejecting nozzle. As a result of the excess pressure that arises, an ink drop is then hurled from the nozzle. The piezo-actuator can be assigned to the ink chamber or to the ink channel. It can, in particular, itself be part of the wall of the ink channel.

In a further advantageous configuration, a pulsed signal is used as the control signal. In this case, a pulsed signal is a signal defined by the height and the duration of the pulses and also by the temporal sequence thereof. In this case, one ink drop is produced per pulse. The number of dots produced in the advancing direction per unit length is controlled by means of the number of pulses per time depending on the advancing speed of the print head or the substrate to be printed. In principle, the pulsed signal can be both a mechanical signal and an electrical signal. In the case of a piezo-printer, the pulsed signal is expediently given by a sequence of voltage pulses, wherein each voltage pulse causes the piezo-actuator to effect a rapid mechanical movement for the ejection of the ink drop.

Preferably, the height and/or the duration of the pulses are/is adapted for the calibration of the ink ejection quantity. An adjustment duration and an adjustment speed for the ejection of the ink drop are predefined for the ink ejecting nozzle by means of a pulse. In this respect, the ink ejection quantity can be regulated or set by means of an adaptation of the amplitude or the height and/or the duration of the pulse. In principle, when the amplitude is increased, a larger ink quantity per drop will be ejected. By means of the duration of the pulse it is possible to influence the vibration behavior of the ink situated in the ink channel. In particular, the meniscus of the ink surface that is situated at the exit is influenced by the vibration behavior, which in turn alters the ink quantity ejected per drop. In this case, too, it holds true, in principle, that lengthening the pulse duration within a certain scope leads to an increase in the ink quantity per drop.

Alternatively or additionally, the pulsed signal can be modulated in a stepped manner for the calibration of the ink ejection quantity. In other words, an intermediate level is introduced between the high signal level and the low signal level of a pulse. The ink quantity ejected per drop can likewise be set by means of such an intermediate level.

In the case of a piezo-printer, wherein voltage pulses are respectively applied to the piezo-actuators for driving purposes, it has been found that voltage variations in the range of +/−0.1 Volt and time variations of the pulse duration in the range of +/−0.5 ms are advantageous for calibration purposes.

In one advantageous configurational form, proceeding from the determined value of the measurement parameter, the control signal is adapted in accordance with a table. In this case, the table entries can be based on empirical values which have been gathered and collected in the course of a plurality of printing operations. In particular, the table entries can also be derived in a self-leaning manner from unsuccessful attempts or successful attempts. The table entries can also be adapted to altered external circumstances caused by wear or aging of the inkjet printer.

The assignment of defined adaptations of the control signal to determined values of the measurement parameter is effected by means of the table, such that a simple and rapid adaptation of the control parameters can be effected. In this case, it can be provided that the changed control parameters are directly predefined. As an alternative to this, it can also be provided that change values for adapting the control signal are predefined by the table entries. The table is stored, in particular, in a nonvolatile memory of the printer, such that the calibration can also be carried out automatically after the determined value of the measurement parameter has been input.

In an alternative configuration, the control signal is adapted proceeding from the determined value of the measurement parameter by means of a functional relationship. By means of the functional relationship, the control signal or control parameters describing the control signal is or are directly correlated with the measurement parameter. This makes it possible, in particular, to perform a calibration-dictated adaptation of the control signal directly proceeding from the measured value of the measurement parameter. The corresponding functional relationship is determined theoretically or derived empirically from measured values, for example. By means of a corresponding, for example computer-aided, evaluation of the measured values, the adaptation of a control signal can be achieved therefrom in a simple manner.

By means of a self-learning algorithm it is possible to obtain in an automated manner the relationship between a determined value of the measurement parameter and a control signal adaptation that is necessary in the context of the calibration. This procedure enables rapid optimization of the calibration process.

In a further preferred configuration, reduced pressure is applied to an ink chamber of the inkjet printer and the reduced pressure is set by means of the control signal. In other words, for calibrating the ink ejection quantity per dot, a settable reduced pressure in the ink chamber is used by itself or in addition. The ink meniscus established in the ink ejecting nozzles is influenced by means of such a reduced pressure, as a result of which a reference to the ink ejection quantity per dot is directly evident. The difference between the pressure in the ink chamber and the ambient pressure is crucial in this case. A lowering of the reduced pressure generally leads to a reduced ejection quantity per dot.

The reduced pressure in the ink chamber can be set by means of a controllable fan for example. In the case of a conventional inkjet printer, the settable range of the reduced pressure in the ink chamber relative to the ambient pressure is preferably between minus ten and minus fifty millimeters of water column. For calibrating the ink ejection quantity per dot it is again possible to have recourse to a table of values or to comparison values that are based on empirical values.

Furthermore, the ink ejection quantity per dot can advantageously be calibrated to a predefined standard value by an ink of the inkjet printer being temperature-regulated, wherein the ink temperature is set by means of the control signal. Such a calibration is based on a dependence of the viscosity of the ink on the ink temperature. This is because many inks exhibit such a viscosity dependent on the ink temperature, which viscosity can be gathered, if appropriate, from corresponding data sheets from the manufacturers. Generally, it can be formulated, in particular, that the ink ejection quantity per dot increases as the viscosity of the ink increases. The reason for this is the fact that the separation instant for the ink drop is delayed owing to the increased viscosity. Taking account of the temperature-dependent viscosity behavior of the ink used, temperature regulation of the ink can therefore likewise be used for calibrating the ink ejection quantity per dot.

Suitable temperature-regulating devices can be heating or cooling devices assigned either to the ink chamber, to the ink supply lines or to the ink ejecting nozzle. In this case, the temperature-regulating unit (for example suitable temperature-regulating lines) can be arranged both outside and within the ink, or else the walls of the ink-guiding containers themselves can be configured as temperature-regulatable.

The second-mentioned object is achieved according to the invention by means of a print product printed by an inkjet printer calibrated according to the method described above.

The advantages mentioned for the method can be applied analogously to the print product. Print products of this type are substantially free of metamerism. In particular, independently of the type of inkjet printer or its form on the day, they are always printed with the screen density defined by the digital original. Different batches of the print products have no differences in terms of color perception. In this respect, the print products satisfy the stringent requirements in the industrial production of identical mass-produced goods such as floor coverings, worktops, etc., wherein a decorative print is applied to the respective substrate.

The inkjet printer calibration according to the invention makes it possible to produce an in principle unlimited number of print products having an optically identical appearance. External influences such as, for example, a fluctuating air pressure or a fluctuating temperature which occasionally cause a changing form on the day of the inkjet printer have no influence on the optical appearance of the print products. In particular it becomes possible to avoid optical deviations of the print products among one another which can be attributed to metamerism phenomena.

Other features which are considered as characteristic for the invention are set forth in the appended claims.

Although the invention is illustrated and described herein as embodied in a method for calibrating an inkjet printer and print product, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
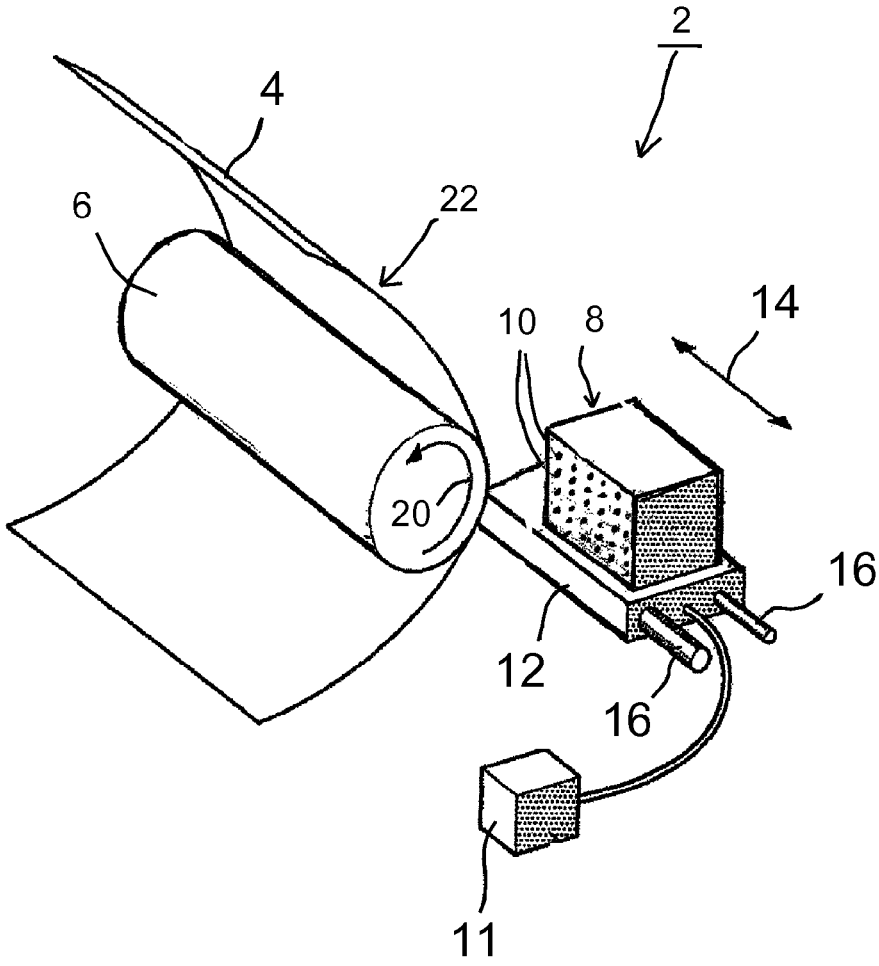
FIG. 1 is a schematic perspective view showing an inkjet printer.

Referring now to the figures of the drawing in detail and first, particularly, to FIG. 1 thereof, there is shown an inkjet printer 2 and also a substrate 4 to be printed, which is guided on a roll 6.

The inkjet printer 2 comprises a print head 8 embodied in a block-like fashion with a number of ink chambers and a number of ink-ejecting nozzles 10. The ink chambers store ink of different colors, in particular the primary colors black, cyan, magenta and yellow. The print head 8 is mounted on a slide 12, which is movable in a displacement direction 14 along two guide rods 14. Furthermore, the inkjet printer 2 comprises a control unit 11 for driving the ink ejecting nozzles 10.

The roll 6, on which the substrate 4—here in the form of a sheet of paper—is guided, is rotatable about its rotational axis in a rotation direction 20.

For a printing process, the print head 8 of the inkjet printer 2 and the substrate 4 are moved relative to one another. That is to say, in particular, that the substrate 4 is transported past the print head 8 by means of a rotation of the roll 6 in a direction transversely with respect to the displacement direction 14 of the slide 12. Simultaneously therewith, the print head 8 is moved to and fro by means of the slide 12 along the displacement direction 14. In order to print a printed image onto the substrate 4, the control unit 11 drives the ink ejecting nozzles 10 for ejection of ink in accordance with the stipulations of a dot screen. For this purpose, the ink ejecting nozzles 10 can be driven individually by the control unit 11, wherein the driven ink ejecting nozzles 10 each eject an ink drop onto the carrier element 4. For this purpose, the openings of the ink ejecting nozzles 10 in each case face in the direction of the substrate 4. An ejected ink drop substantially produces a printed dot on the substrate 4. On account of the relative movement of the substrate 4 and the print head 8 with respect to one another, the ejection of ink drops that is driven by the control unit 11 results in a distribution of the printed dots on the substrate 4 which corresponds to the dot screen predefined by a digital original. the number of dots, the dot density and the color of the dots determine the printed image that can be optically perceived by an observer. The printed substrate 4 constitutes a desired print product 22. The image data which are provided by a digital original and which are based on the dot screen are read in by the control unit 11 during or before the printing process. The digital original is present for example in the form of an electronic memory file of a specific format.

Figure 2:
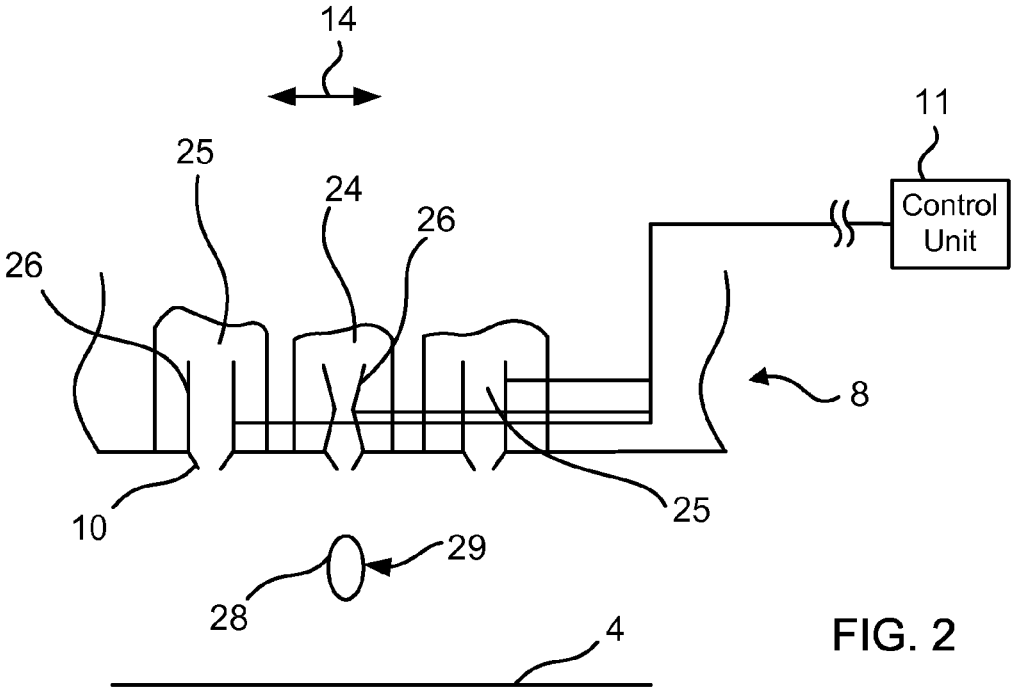
FIG. 2 is a diagrammatic cross section through a print head.

FIG. 2 schematically shows a print head 8 in a cross-sectional illustration. The illustrated excerpt illustrates a number of ink chambers 24 by way of example. The ink chambers 24 illustrated by way of example in each case store ink of a different color, e.g. cyan, black, yellow. A respective ink ejecting nozzle 10 arranged at the corresponding ink chambers 24 is visible in the cross section illustrated. Each of the ink ejecting nozzles 10 furthermore comprises an ink channel 25, the walls of which is formed by piezo-actuators 26. By means of corresponding driving, the wall is curved inward, such that an excess pressure is generated in the respective ink channel 25. As a consequence, ink is ejected from the driven ink ejecting nozzle 10. In FIG. 2, this driving is visible at the middle one of the ink ejecting nozzles 10. The walls of the ink channel 25 are curved inward there. The ejected ink dot 28 is depicted.

For ink ejection, an electrical voltage in the form of a voltage pulse is applied to the piezo-actuators 26 of an ink ejecting nozzle 10 by means of the control unit 11. The voltage applied by way of the voltage pulse brings about a deformation of the piezo-actuators 26 which leads to curvature of the wall of the ink channel 25 inward, thus to a reduction of the volume there and hence to an impulsive build-up of pressure.

The ejected ink drop 28 comprises a defined ink ejection quantity 29, which produces a dot upon impinging on the substrate to be printed. As will be explained with respect to FIG. 3, the volume of the ink drop 28 and hence the ink ejection quantity 29 per dot is set to a calibrated value by the control unit 11 in particular by means of an adaptation of the height and the duration of the voltage pulse applied to the piezo-actuators 26.

With otherwise identical control parameters, the volume of the ink drop 28 emitted by the or each ink ejecting nozzle 10 of the inkjet printer 2 is influenced by external factors such as air pressure, temperature or air humidity. Such a variation of the ink drop volume leads to a corresponding variation of the size and the thickness of the printed dots. This has the consequence that the printed image of a dot screen which is printed at different times appears differently to an observer in terms of optical perception, depending on whether the ink ejection quantity 29 is lower or higher. A difference in the perception of the mixed colors and also the color strength will arise, inter alia.

Figure 3:
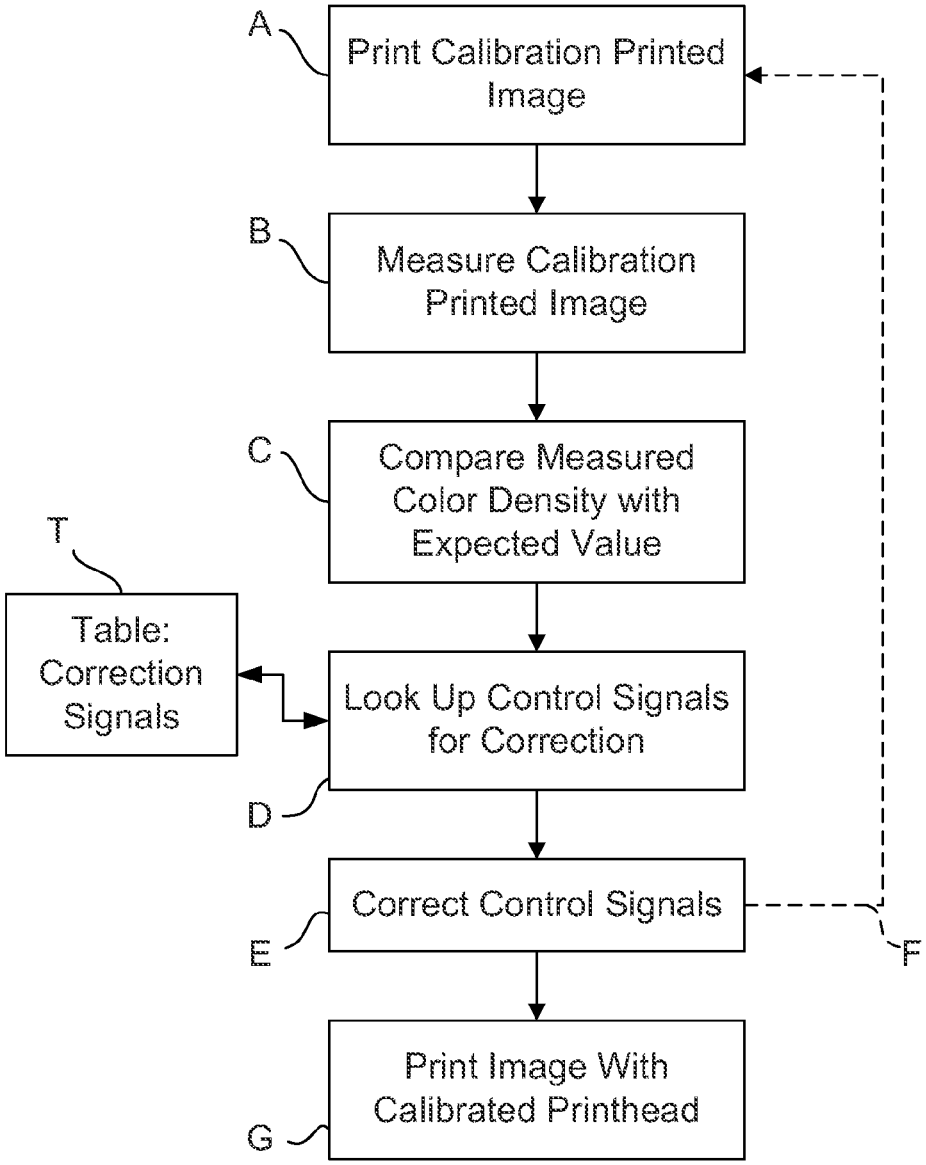
FIG. 3 is a flow chart illustrating a calibration process.

In order to counteract such influencing of the printed result, the inkjet printer 2 is calibrated near the time of the intended printing operation with regard to the ink ejection quantity 29 per dot, which is given by the volume of the ink drop 28. This procedure is illustrated in FIG. 3.

In a first step A of the calibration operation, firstly the inkjet printer is driven with a predefined calibration screen for printing out a defined calibration printed image. In this case, the calibration printed image is generated in a frequency-modulated manner, i.e. by means of a temporal modulation of the control pulses during the movement of the printing original relative to the print head. In principle, a single calibration print of a color suffices for detecting the form on the day of the printer. However, since the inks of different primary colors, on the one hand, and of different batches, on the other hand, vary in terms of their material properties, it is recommendable to generate a dedicated calibration printed image for each primary color. Varying material properties of the inks are also taken into account in this way.

In the next method step B, the calibration printed image is measured. For this purpose, the color density of the print-out is measured optically by means of a densitometer. In other words, the value of the color density is determined, said color density representing a measure of the ink application that has been effected. In this case, the reflectance reflected from the print sheet in the case of a predefined standard light is assessed and the value of the color density is determined therefrom, as already indicated.

In the next step C, the measured value of the color density is compared with the expected value of the color density such as should ideally arise or has arisen in the case of standardized ambient parameters of the inkjet printer. A deviation is then determined from the difference between the measured value and the expected value of the color density.

In step D, adaptations of the control signal is interrogated by means of a value table T based on empirical values, in which table change values for the control signal are assigned to specific deviations of the measured color density. In this case, the table values may have been determined directly by previous measurement series, the effects of defined variations of the control signal on the color density having been examined empirically. However, the table values can also be derived from previous calibration operations. In particular, the table values, in the course of time, can also be adapted to aging processes of the printer since, as a result, identical changes in the control signal can possibly have changed effects. Finally, it is also possible to teach an intelligent system, by means of different measurement series, a relationship between deviations of the color density and necessary changes in the control signal for a correction.

In a further step E, the interrogated changes are imposed on the control signal of the ink ejecting nozzles. This has the consequence that, even in the case of the current changed ambient parameters, the printer again produces an ink application such as corresponds to standard conditions. In other words, the ink ejection quantity per dot or the volume of an ejected ink drop is calibrated.

Optionally in a step F, the result of the calibration can be checked by means of a test print-out with changed control signals in accordance with step A and renewed measurement of the color density. Depending on the result, steps A to E can then be repeated until the desired result is achieved.

Finally, in step G, with the changed control signals, the printed image is generated in accordance with a digital original. A print product of this type meets the stringent requirements made of reproducibility in the case of a commercial application, and in particular in the case of decorative prints on mass-produced goods.

In addition, the calibration method specified does not result in reformatting—requiring computing power—of the print data before the latter are sent to the printer, as is the case in conventional calibration methods. While in the case of conventional methods for calibration the printing screen is modulated relative to the original in order to obtain the desired result despite changed ambient parameters, in the present case the control signals are adapted with an unchanged printing screen. In this respect, the technical state and the type of the printer are adapted, rather than the print file.

Since the printing screens in the case of all print products printed by means of an inkjet printer calibrated in this way are imprinted identically in accordance with the original file or digital original, metamerism effects caused by different printing screens are eliminated. Print products from different batches not only have high identity with regard to the color impression, but moreover are also substantially free of metamerism.

Figure 4:
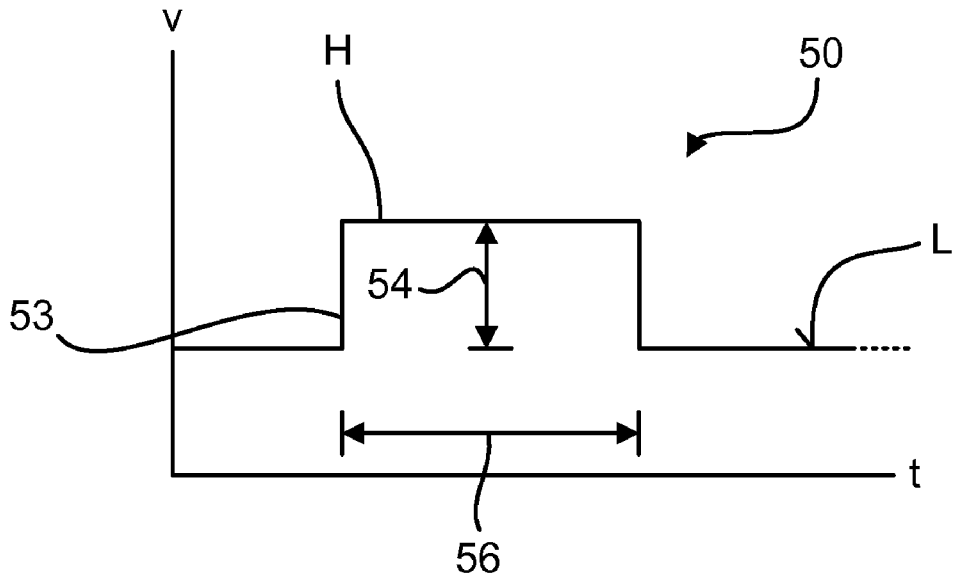
FIG. 4 shows a diagram of a voltage pulse.

A voltage pulse 52 for driving an inkjet printer driven by means of a piezo-actuator is illustrated in an excerpt from a pulsed signal 50 in a diagram in FIG. 4. In the diagram, the amplitude V of the voltage pulse is plotted against time t. The pulsed signal 50 has substantially two levels, namely a low level L and a high level H. When the high level L is applied to the piezo-actuator or to the corresponding ink ejecting nozzle, an ink drop of a given volume is ejected by means of a compression of the ink channel. A setting of the volume of the ejected ink drop is possible by way of the height 54 of the high level H above the low level L and also by way of the duration 56 of the high signal, that is to say the shape of the voltage pulse 52.

A calibration of the ink ejection quantity per dot in accordance with the above-described method takes place, in particular, by means of an adaptation of the height 54 and of the temporal duration 56 of the voltage pulse 52. In this case, for increasing the ink ejection quantity, substantially the height 54 of the applied voltage pulse 52 is raised. By means of a change in the temporal duration 56 of the voltage pulse 52 applied to the piezo-actuator, the vibration behavior of the ink meniscus established at the opening of the ink channel can be changed, such that the drop volume of the ejected ink can likewise be altered by this means. The new duration 56 to be set in the case of a predefined difference in the measured color density is based on empirical values obtained for the respective printer.

The invention claimed is:

1. A method of calibrating an inkjet printer having a print head with a plurality of ink ejecting nozzles to be driven by way of a control signal, the method to be effected near a time of an intended printing operation, the method which comprises:

printing an individual predefined calibration screen with the inkjet printer for a given color;

determining from the printed calibration screen a value of an averaged measurement parameter characterizing the ink application, the measurement parameter being averaged over an entire printed image; and calibrating an ink ejection quantity per dot to a predefined standard value using the value of the averaged measurement parameter obtained in the determining step by adapting the control signal.

2. The method according to claim 1, which comprises:

comparing the determined value of the measurement parameter with a predefined comparison value; and calibrating the ink ejection quantity per dot in dependence on a result of the comparing step.

3. The method according to claim 1, which comprises selecting a color density as the measurement parameter characterizing the ink application.

4. The method according to claim 3, which comprises determining the value of the color density by way of an optical measurement.

5. The method according to claim 1, wherein the ink ejecting nozzle or each of the ink ejecting nozzles comprises a piezo-actuator selectively driven to eject ink by way of the control signal.

6. The method according to claim 5, wherein the control signal is a pulsed signal.

7. The method according to claim 6, which comprises adapting at least one of a level and a duration of pulses of the pulsed signal for calibrating the ink ejection quantity.

8. The method according to claim 6, which comprises modulating the pulses of the pulsed signal in a stepped manner for calibrating the ink ejection quantity.

9. The method according to claim 6, which comprises using a sequence of voltage pulses as the pulsed signal.

10. The method according to claim 1, which comprises, proceeding from the determined value of the measurement parameter, adapting the control signal in accordance with a table.

11. The method according to claim 10, wherein the table contains table entries adapted taking account of empirical values.

12. The method according to claim 1, which comprises adapting the control signal proceeding from the determined value of the measurement parameter by way of a functional relationship.

13. The method according to claim 1, which comprises applying a reduced pressure to an ink chamber of the inkjet printer and setting the reduced pressure by way of the control signal.

14. The method according to claim 1, wherein an ink of the inkjet printer is temperature-regulated, and wherein the ink temperature is set by way of the control signal.

15. The method according to claim 1, which comprises employing a self-learning algorithm for adapting the control signal.

16. A print product printed by an inkjet printer calibrated according to the method according to claim 1.

* * * * *